US006471142B1

(12) United States Patent
Lambert

(10) Patent No.: US 6,471,142 B1
(45) Date of Patent: Oct. 29, 2002

(54) FUEL INJECTOR

(75) Inventor: Malcolm David Dick Lambert, Bromley (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/540,254

(22) Filed: Mar. 31, 2000

(30) Foreign Application Priority Data

Apr. 1, 1999 (GB) ..... 9907565
Mar. 4, 2000 (GB) ..... 0005165

(51) Int. Cl.[7] ..... F02M 47/02
(52) U.S. Cl. ..... 239/88; 239/96
(58) Field of Search ..... 239/88, 89, 90, 239/95, 96, 533.8, 533.9, 584, 585.1

(56) References Cited

U.S. PATENT DOCUMENTS 3,747,857 A * 7/1973 Fenne ..... 239/90
4,674,688 A * 6/1987 Kanesaka ..... 239/96
4,776,518 A * 10/1988 Yamamoto ..... 239/88
4,852,808 A * 8/1989 Yamamoto ..... 239/88
6,024,297 A * 2/2000 Greeves ..... 239/96

* cited by examiner

*Primary Examiner*—Lesley D. Morris
*Assistant Examiner*—Christopher Kim
(74) *Attorney, Agent, or Firm*—Thomas N. Twomey

(57) ABSTRACT

A fuel injector comprising a valve needle slidable within a first bore, a surface associated with the valve needle being exposed to the fuel pressure within a first control chamber and movement of the valve needle away from the valve needle seating being limited by a moveable stop member. The stop member has a surface exposed to fuel pressure within a second control chamber. The fuel injector also includes a control valve arrangement for controlling the fuel pressure within the first and second control chambers to control movement of the valve needle and the stop member. The invention also relates to a fuel injector in which the control valve arrangement is arranged to permit the rate of valve needle movement away from the valve needle seating to be varied, in use.

3 Claims, 13 Drawing Sheets

FUEL INJECTOR

TECHNICAL FIELD

This invention relates to a fuel injector for use in delivering fuel under pressure to a combustion space of an internal combustion engine. The invention relates, in particular, to a fuel injector suitable for use in a common rail fuel system for delivering fuel to a compression ignition internal combustion engine, the injector being of the type in which the distance through which the injector needle moves during an injection cycle is controlled.

BACKGROUND OF THE INVENTION

It is known to use two- or multi-stage lift fuel injectors to permit the rate at which fuel is delivered or the fuel spray pattern to be varied, in use. This may be achieved, for example, by locating an inner needle within a bore formed in an outer needle, the inner needle being arranged to remain seated when the outer needle is moved by a small distance, moving away from its seating when the outer needle is moved by a larger distance. In such an arrangement, injection of fuel may occur, for example, through a few outlet openings upon the initial small movement of the outer needle and through a greater number of openings following the subsequent movement of the outer and inner needles. As a result, the injection rate and spray pattern may be varied, in use. Other injection parameters may also be controlled or varied using this technique. It will be appreciated, however, that other techniques for controlling the various injection parameters by controlling the distance moved by a valve needle are known.

The distance through which the valve needle is moved is typically controlled by controlling the energization level, and hence axial length, of a piezoelectric stack. Such an actuation technique is thought to be undesirable as piezoelectric stacks of dimensions suitable for use in such applications are relatively expensive and are difficult to control. It is an object of the invention to provide a fuel injector in which the distance moved by a valve needle thereof can be controlled and in which the disadvantages mentioned hereinbefore are obviated or mitigated.

SUMMARY OF THE INVENTION

According to the present invention there is provided a fuel injector comprising a valve needle slidable within a bore, a surface associated with the needle being exposed to the fuel pressure within a first control chamber, movement of the needle away from a seating being limited by a moveable stop member, the stop member having a surface exposed to the fuel pressure within a second control chamber, and a valve arrangement controlling the fuel pressures within the first and second control chamber to control the positions of the needle and the moveable stop member.

By appropriately controlling the fuel pressures applied to the first and second control chambers, the valve needle can be held in either a closed position, an intermediate position or a fully lifted position. Depending upon the nature of the valve needle and any additional needle, sleeve or adjustment member associated with the valve needle, such control of the position of the valve needle may be used to control the fuel injection rate, spray pattern or other injection parameters.

The valve arrangement conveniently includes a common actuator arranged to control operation of a first valve associated with the first control chamber and a second valve associated with the second control chamber. The actuator may, for example, comprise an electromagnetic actuator or a piezoelectric stack. It will be appreciated, however, that the first and second valves may be controlled by respective actuators. Conveniently, the fuel injector includes a control valve arrangement including a valve member having first and second seating surfaces. The first seating surface may be defined by a seating member located within a further chamber. The further chamber may be defined, at least in part, by a bore within which the valve member is slidable. The second seating surface may be defined by a region of the bore.

The control valve arrangement may be arranged such that fuel pressure within the first and second control chambers can be controlled by varying the rate of movement of the valve member away from the first seating surface.

Preferably, the control valve arrangement may be arranged such that, in use, movement of the valve member at a relatively high rate causes movement of the valve needle away from the valve needle seating into a first fuel injecting position to permit fuel delivery through a first outlet opening.

Preferably, the control valve arrangement may be arranged such that movement of the valve member at a relatively low rate causes movement of the valve needle away from the valve needle seating into a second fuel injecting position to permit fuel delivery through the first outlet opening and a second outlet opening.

Alternatively, or in addition, the control valve arrangement may be arranged such that movement of the valve member back and forth between the first and second seating surfaces causes movement of the valve needle into the second fuel injecting position.

Alternatively, or in addition, the control valve arrangement may be arranged such that movement of the valve member into an intermediate position away from both the first and second seating surfaces permits movement of the valve needle into the second fuel injecting position.

The control valve arrangement may be arranged to permit the rate of valve needle movement away from the valve needle seating to be varied, in use.

The fuel injector may be of the inwardly opening type.

The valve needle may take the form of an outer valve needle which is engageable with a seating to control fuel delivery through a first outlet opening, the fuel injector including an inner valve needle which is slidable within an additional bore provided in the outer valve needle and is engageable with a further seating to control fuel delivery through a second outlet opening. The inner valve needle and the outer valve needle may be arranged such that movement of the outer valve needle beyond a predetermined amount transmits movement to the inner valve needle to move the inner valve needle away from the further seating. Alternatively, the valve needle may be of the outwardly opening type, in which case the valve needle may be provided with first and second axially spaced outlet passages and whereby, in use, movement of the valve needle outwardly within the first bore by a first amount causes fuel to be delivered through only the first outlet passage and movement of the valve needle outwardly within the first bore by a further amount causes fuel to be delivered through both the first and second outlet passages.

The movement of the valve member may be controlled, in use, by means of an electromagnetic actuator arrangement or by means of a piezoelectric actuator arrangement.

According to a second aspect of the present invention, there is provided a fuel injector comprising a valve needle slidable within a first bore and engageable with a valve needle seating to control fuel delivery through an outlet opening, a surface associated with the valve needle being exposed to the fuel pressure within a control chamber, and a control valve arrangement for controlling the fuel pressure within the control chamber to control movement of the valve needle, the control valve arrangement being arranged to permit the rate of valve needle movement away from the valve needle seating to be varied, in use.

As the rate of valve needle movement can be varied, in use, the rate of increase of fuel delivery can be varied.

Preferably, the control chamber may have, associated therewith, first and second passage means for permitting fuel to escape from the control chamber.

Conveniently, the control valve arrangement may be arranged to operate in either a first mode of operation, in which the rate of valve needle movement away from the valve needle seating is governed by the dimensions of the first passage means, or a second mode of operation, in which the rate of valve needle movement away from the valve needle seating is governed by the dimensions of the second passage means.

The valve needle in accordance with this embodiment of the invention may be of the inwardly or outwardly opening type.

It will be appreciated that the fuel injector of the present invention may include a plurality of first and second outlet openings.

According to a further aspect of the invention, there is provided a fuel injector arrangement comprising a plurality of fuel injectors as described herein, a first rail for delivering pressurised fuel to the injectors, a second rail communicating with the second control chamber of each of the injectors and a valve arrangement for controlling communication between the second rail and a low pressure fuel reservoir.

BRIEF DESCRIPTION OF THE DRAWINGS

The invention will further be described, by way of example, with reference to the accompanying drawings, in which.

DESCRIPTION OF THE PREFERRED EMBODIMENT

Figure 1:
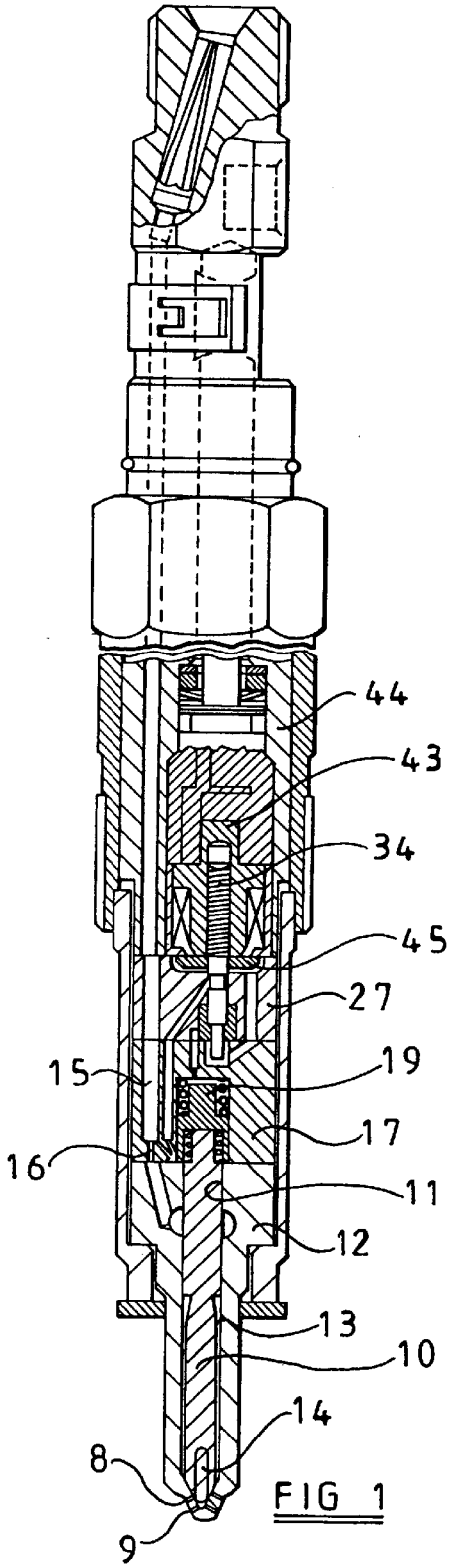
FIG. 1 is a view, partly in cross-section, of a fuel injector in accordance with an embodiment of the invention.
Figure 2:
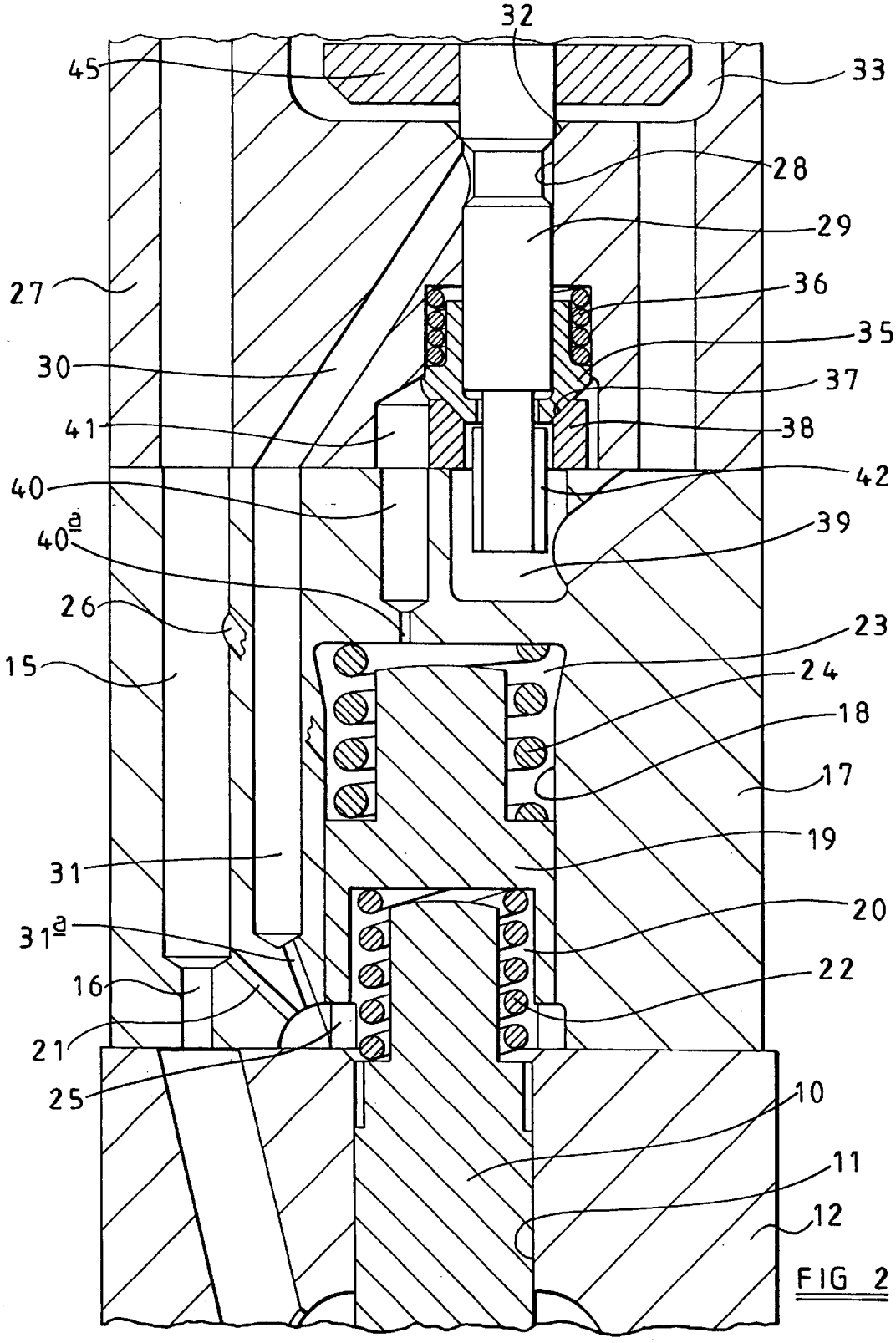
FIG. 2 is an enlarged view of part of FIG. 1.

FIGS. 1 and 2 illustrate a common rail fuel injector which comprises a valve needle 10 slidable within a bore 11 formed in a nozzle body 12. The needle 10 and bore 11 together define a delivery chamber 13 which is located immediately upstream of a seating surface with which the needle 10 is engageable to control the supply of fuel from the delivery chamber 13 to a first set of outlet openings 8 located immediately downstream of the line of engagement between the needle 10 and seating surface. The needle 10 is provided with a blind bore within which an inner needle 14 is slidable. The inner needle 14 is held captive within the blind bore and is arranged such that upon movement of the needle 10 away from the seating surface by a small distance, the inner needle 14 remains in engagement with the seating surface, preventing fuel from flowing to a second set of outlet openings 9, movement of the valve needle 10 by a further distance causing the inner valve needle 14 to lift away from the seating surface thus permitting fuel delivery through the second set of outlet openings 9. It will be appreciated that by controlling the distance through which the valve needle 10 is lifted away from the seating surface, the number of outlet openings through which fuel is delivered can be controlled, and thus the injection rate, spray pattern or other injection characteristics or parameters can be controlled.

The bore 11 and delivery chamber 13 are supplied with fuel under high pressure, in use, through a supply passage 15. The supply passage 15 is formed of drillings provided in various parts of the injector which will be described in further detail below. The supply passage 15 is shaped to include a restriction 16 of relatively small diameter which is arranged to restrict the rate at which fuel is supplied to the bore 11 and delivery chamber 13. The supply passage 15 is arranged to be connected, in use, to a source of fuel under high pressure, for example a common rail charged with fuel to a high pressure by an appropriate high pressure fuel pump.

As illustrated most clearly in FIG. 2, the restriction 16 is provided in a part of the supply passage 15 which extends through a distance piece 17 arranged to abut an end surface of the nozzle body 12. The distance piece 17 is provided with an axially extending blind bore 18 into which an upper end region of the needle 10 extends. A moveable stop member 19 is located within the bore 18, the moveable stop member 19 being of piston-like fit within the bore 18. The lower surface of the moveable stop member 19 defines, with the upper surface of the needle 10, a first control chamber 20 which is supplied with fuel at a restricted rate from the supply passage 15 through a restriction 21. A spring 22 is located within the first control chamber 20, the spring 22 being engaged between the needle 10 and the moveable stop member 19 to apply a biasing force to the needle 10 urging the needle 10 into engagement with the seating surface.

The upper surface of the moveable stop member 19 defines, with the bore 18, a second control chamber 23 within which an additional spring 24 is located, the spring 24 applying a downward biasing force to the moveable stop member 19. The spring 24 biases the moveable stop member 19 towards the position illustrated in which the lower end surface of the moveable stop member 19 engages the upper end surface of the nozzle body 12. The lower end of the moveable stop member 19 is provided with cross slots 25 arranged to ensure that when the moveable stop member 19 occupies this position, fuel is able to flow to or from the first control chamber 20.

A drilling 26 of small diameter is provided in the distance piece 17 to provide a restricted flow path between the supply passage 15 and the second control chamber 23.

The end surface of the distance piece 17 remote from the nozzle body 12 abuts a valve housing 27 which is provided with a through bore 28 within which a control valve member 29 is located. The valve member 29 is shaped to include a reduced diameter region which defines, with the bore 28, a chamber which communicates with the first control chamber 20 through a passage 30 provided in the valve housing 27 and a passage 31 provided in the distance piece 17, the passage 31 including a region 31 a of small diameter. The valve member 29 includes an enlarged diameter region which is engageable with a first seating surface 32 to control communication between the passage 30 and a chamber 33 which communicates, in use, with a low pressure fuel reservoir. It will be appreciated that when the valve member 29 engages the first seating surface 32, fuel is not permitted to flow from the first control chamber 20 to the low pressure reservoir. Thus, with the supply passage 15 connected to a source of fuel under high pressure, the first control chamber 20 will be pressurized to a high level. Movement of the valve member 29 away from the first seating surface 32 permits fuel to escape from the first control chamber 20, the restricted communication between the control chamber 20 and the supply passage 15 ensuring that fuel is only permitted to flow towards the first control chamber 20 at a low rate, and as a result, the fuel pressure within the first control chamber 20 falls. The valve member 29 is biased by means of a spring 34 towards the position illustrated in FIGS. 1 and 2 in which the valve member 29 engages the first seating surface 32.

Slidable upon part of the valve member 29 is a second valve member 35, the second valve member 35 being a substantially piston-like fit upon the valve member 29. The second valve member 35 is biased by means of a spring 36 into engagement with a second seating surface 37 provided upon a seating member 38 which rests, in a sealing manner, upon the distance piece 17. The seating member 38 is of annular form defining a central passage which communicates with a bore 39 provided in the distance piece 17, the bore 39 communicating through passages provided in the distance piece 17 and valve housing 27 with the chamber 33. The distance piece 17 is provided with a drilling 40 having a region 40*a* of small diameter which communicates with the second control chamber 23. A chamber 41 is defined in the valve housing 27 such that fuel is supplied from the drilling 40 towards the second seating surface 37. When the second valve member 35 engages the second seating surface 37, fuel is unable to flow from the second control chamber 23 to the bore 39 and low pressure fuel reservoir and, as a result of the communication between the supply passage 15 and the second control chamber 23, the second control chamber 23 will be at high pressure. When the second valve member 35 is lifted away from the second seating surface 37, fuel is able to escape from the second control chamber 23 to the bore 39, thus relieving the fuel pressure within the second control chamber 23.

Movement of the second valve member 35 is controlled by means of the valve member 29. As illustrated in FIG. 2, the valve member 29 extends through an opening provided in the second valve member 35, a sleeve member 42 being secured to the valve member 29 such that movement of the valve member 29 in an upward direction in the orientation illustrated beyond a predetermined distance results in the sleeve 42 moving into engagement with the second valve member 35, further movement of the valve member 29 resulting in the second valve member 35 lifting away from the second seating surface 37.

Movement of the valve member 29 is controlled by means of an electromagnetic actuator 43 located within a nozzle holder 44 which abuts an upper end surface of the valve housing 27. The actuator 43 is energizeable to attract an armature 45 which is secured to the valve member 29 to cause movement of the valve member 29 away from the first seating surface 32.

In use, with the supply passage 15 connected to a suitable source of fuel under high pressure, for example the common rail of a common rail fuel system which is charged to a suitably high pressure by an appropriate high pressure fuel pump, and with the actuator 43 de-energized, the valve member 29 will occupy the position illustrated in which it engages the first seating surface 32, the second valve member 35 engaging the second seating surface 37. It will be appreciated, therefore, that both the first and second control chambers 20, 23 will be at high pressure, and the action of the fuel under pressure in combination with the action of the springs 22, 24 will ensure that the valve needle 10 engages its seating.

When injection is to occur, the actuator 43 is energized. Such energization will initially cause movement of the valve member 29 away from the first seating surface 32. As a result, fuel will escape from the first control chamber 20. The relative sizes of the restrictions 21, 31*a* are such as to ensure that, under such conditions, the fuel pressure within the first control chamber 20 falls, fuel flowing towards the first control chamber 20 at a rate lower than the rate at which fuel is able to escape from the first control chamber 20. The reduction in the fuel pressure within the first control chamber 20 reduces the net downward force applied to the needle 10, and a point will be reached beyond which the fuel pressure within the delivery chamber 13 acting upon appropriately orientated thrust surfaces of the needle 10 will be sufficient to cause the needle 10 to lift away from the seating surface against the action of the residual fuel pressure within the first control chamber 20 and the action of the spring 22. Movement of the needle 10 will be limited by the upper end surface of the needle 10 moving into engagement with the moveable stop member 19, the needle 10 occupying an intermediate lift position. The distance through which the valve needle 10 moves is sufficiently small to ensure that the inner valve needle 14 remains in engagement with its seating, thus fuel injection occurs only through some of the outlet openings.

As the fuel pressure within the second control chamber 23 is high and the effective area of the stop member 19 exposed to this pressure is large compared to that of the thrust surfaces of the needle 10, the needle 10 is unable to cause movement of the stop member 19, thus the needle 10 does not move beyond the intermediate lift position.

As the valve member 29 continues to move towards the actuator 43, the sleeve 42 will move into engagement with the lower surface of the second valve member 35, continued movement resulting in the second valve member 35 being lifted away from the second seating surface 37. As a result, fuel is able to flow from the second control chamber 23. The dimensions of the drilling 26 and restriction 40*a* are chosen to ensure that, under such conditions, the fuel pressure within the second control chamber 23 falls. The action of the fuel under pressure within the delivery chamber 13 is sufficient to cause the valve needle 10 to lift to a fully lifted position, lifting the moveable stop member 19 against the action of the spring 24 and any residual fuel pressure within the second control chamber 23, the additional movement of the valve needle 10 being sufficient to cause the inner valve needle 14 to lift away from the seating surface, thereby permitting fuel delivery through a greater number of openings. It will be appreciated, therefore, that the injection rate, spray pattern or other injection parameters can be altered, in use.

As a result of the presence of the restriction 16, during fuel injection the fuel pressure within the delivery chamber 13 will fall, and so the magnitude of the upward force acting upon the needle 10 during injection will be lower than that present prior to the commencement of injection.

In order to terminate injection, the actuator 43 is de-energized, the valve member 29 returning to the position illustrated under the action of the spring 34. As a result, fuel flow from both the first and second control chambers 20, 23 will cease, and the fuel pressure within these chambers will increase as a result of their communication with the supply passage 15. As the effective area of the moveable stop member 19 exposed to the fuel pressure within the second control chamber 23 is relatively large, pressurization of the second control chamber 23 in conjunction with the action of the spring 24 will result in rapid initial movement of the valve needle 10 towards its seating. Once the moveable stop member 19 has moved into engagement with the nozzle body 12, further movement of the needle 10 under the action of the increasing fuel pressure within the first control chamber 20 and the action of the spring 22, together with the inertia of the needle 10, will result in rapid movement of the needle 10 into engagement with the seating surface, thus terminating the delivery of fuel. As mentioned hereinbefore, the fuel pressure within the delivery chamber 13 falls during injection, and as a result the response of the injector to the valve member 29 returning to the position illustrated is fast.

Although in the description hereinbefore, the valve member 29 is described as moving substantially continuously from the position illustrated to a fully lifted position, it will be appreciated that by appropriate control of the energization level of the actuator 43, the valve member 29 may be held in a position in which the second control chamber 23 remains pressurized throughout the injection cycle, the needle 10 only moving to the intermediate position in which the inner valve needle 14 remains in engagement with the seating surface. Alternatively, the valve member 29 may be moved rapidly to its fully lifted position, the valve needle 10 moving almost immediately to its fully lifted position rather than stopping temporarily at the intermediate position.

Figure 3:
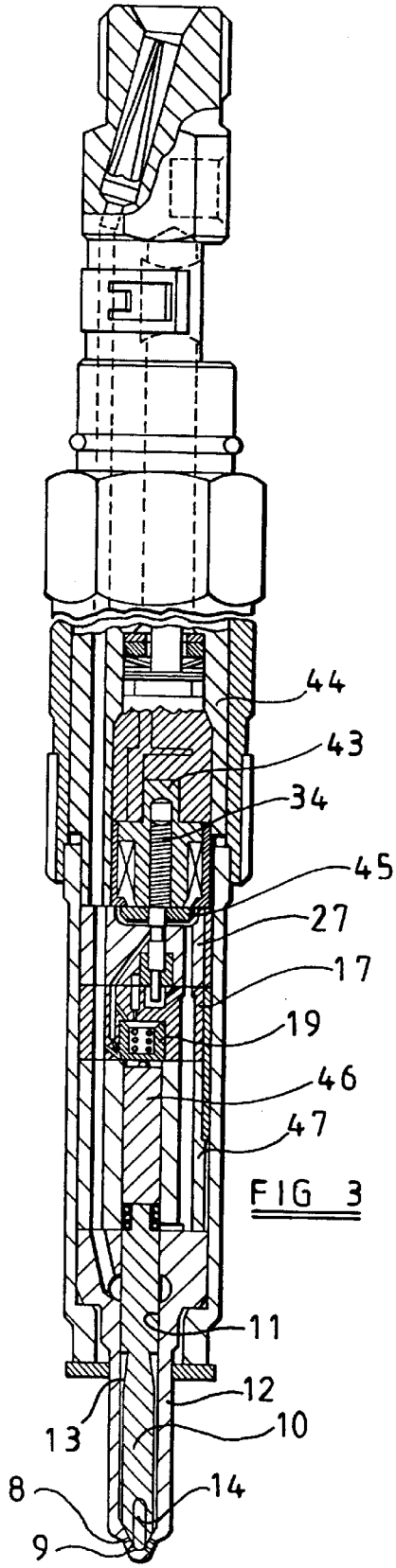
FIGS. 3 and 4 are views similar to FIGS. 1 and 2 illustrating an alternative embodiment.
Figure 4:
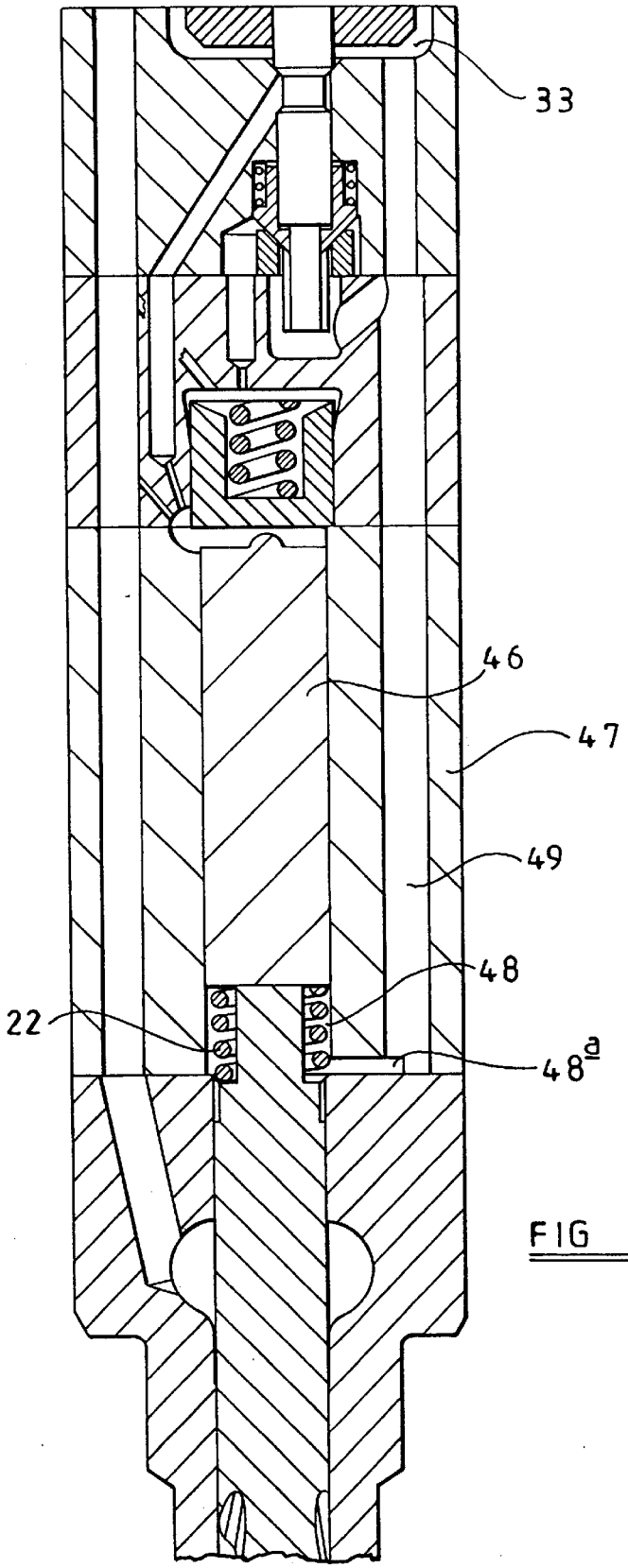

The embodiment illustrated in FIGS. 3 and 4 is similar to that of FIGS. 1 and 2 and only the distinctions between the embodiments will be described in detail. In the arrangement of FIGS. 3 and 4, the restriction 16 is omitted. In order to ensure that the termination of injection occurs rapidly, the upper end of the valve needle 10 is arranged to engage a piston 46 which is located within a piston housing 47 engaged between the nozzle body 12 and the distance piece 17. The piston 46 is of diameter greater than that of the needle 10, the upper end surface of the piston 46 being exposed to the fuel pressure within the first control chamber 20. As the piston 46 and valve needle 10 are of different diameters, a chamber 48 is defined therebetween, the volume of which varies depending upon the position of the needle 10. The spring 22 is located within the chamber 48, the spring serving to urge the valve needle 12 against its seating, as described previously. In order to avoid the formation of a hydraulic lock, the chamber 48 is vented to the chamber 33 through a passage 49, the passage 49 communicating with the chamber 48 by means of a recess 48*a* provided in the lower end face of the housing 47.

Operation of the arrangement is as described hereinbefore with the exception that, during injection, the fuel pressure within the delivery chamber 13 does not fall significantly, rapid termination of injection occurring as a result of the effective area of the piston 46 exposed to the fuel pressure within the first control chamber 20 being large, and thus as the fuel pressure within the first control chamber 20 rises, the downward force applied to the needle 10 increases rapidly. Such a rapid increase results in rapid movement of the needle 10 into engagement with the seating surface, terminating fuel injection.

Figure 5:
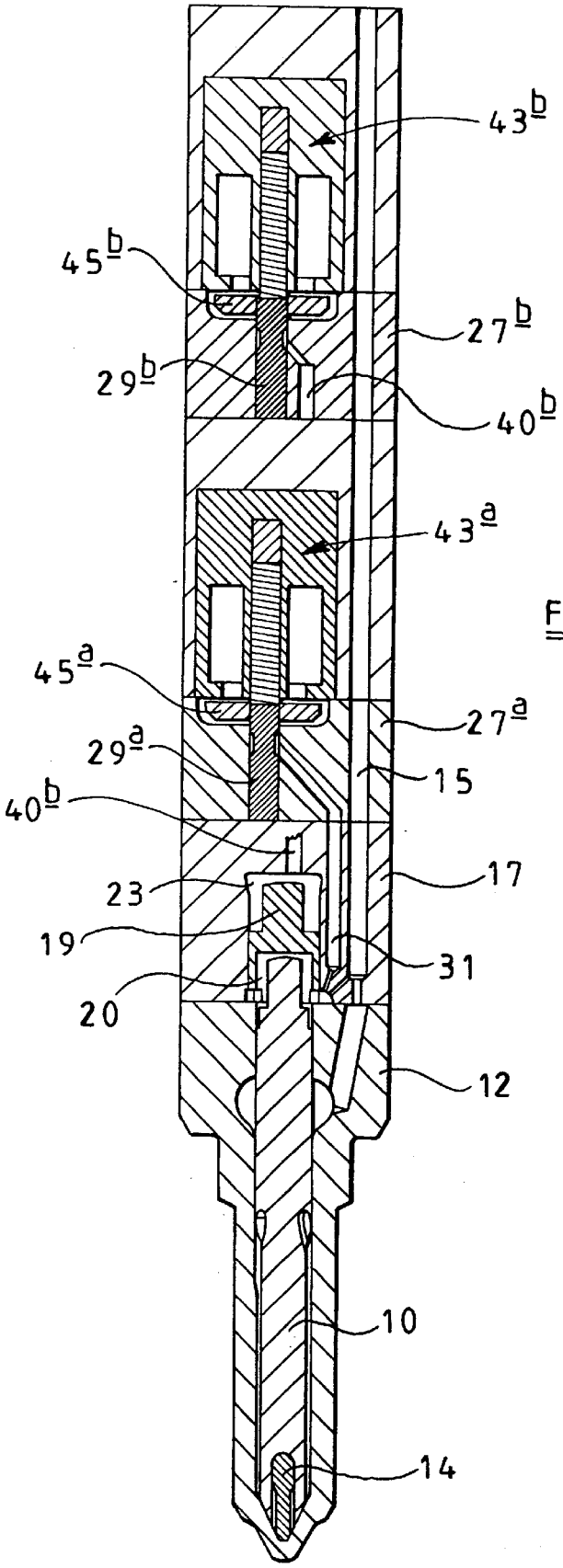
FIG. 5 is a view similar to FIGS. 1 and 3 illustrating a further alternative embodiment.

FIG. 5 shows a further alternative embodiment of the invention in which fuel pressure within the first and second control chambers 20, 23 is controlled by means of two separate actuators 43*a*, 43*b* respectively. For clarity, the springs in the first and second control chambers 20, 23 (e.g. 22 and 24 in FIG. 2) are not illustrated in FIG. 5. The first electromagnetic actuator 43*a* includes a valve member 29*a* which is slidable within a bore provided in a valve housing 27*a*. The actuator 43*a* includes an armature 45*a* which is secured to the valve member 29*a*, energisation of the actuator 43*a* attracting the armature 45*a* so as to cause movement of the valve member 29*a* away from its seating surface. This permits fuel within the first control chamber 20 to flow, via the passage 31, past the valve member seating surface to low pressure. Fuel pressure within the second control chamber 23 is controlled in a similar manner by controlling movement of a second valve member 29*b* by means of the second actuator 43*b*. The second valve member 29*b* is moveable within a bore provided in a further valve housing 27*b*, movement of the second valve member 29*b* away from its seating surface permitting fuel within the second control chamber 23 to flow through the passage 40*b* (shown in part), past the valve seating surface to low pressure so as to reduce fuel pressure in the second control chamber 23.

The injector in FIG. 5 is operated in a similar manner to the injector in FIGS. 1 and 2. Thus, in order to move the valve needle 10 away from the seating surface to expose only some of the outlet openings, the first valve member 29*a* is moved away from its seating surface to cause fuel pressure within the first control chamber 20 to be reduced. The second valve member 29*b* remains seated against its seating surface such that fuel pressure within the second control chamber 23 remains high. Under such circumstances, upward movement of the valve needle 10 is limited by the upper end surface of the needle 10 moving into engagement with the stop member 19. The distance through which the valve needle 10 moves is sufficiently small to ensure that the inner valve needle 14 remains in engagement with its seating so that fuel injection only occurs through some of the outlet openings.

In order to cause further movement of the valve needle 10, the second valve member 29*b* is moved away from its seating surface to permit fuel within the second control chamber 23 to flow through the passage 40*b* to low pressure. This causes a reduction in fuel pressure in the second control chamber 23 such that engagement between the upper end surface of a valve needle 10 and the stop member 19 causes the stop member 19 to move in an upward direction, the further movement of the valve needle 10 being sufficient to cause the inner valve needle 14 to lift away from the seating surface to permit fuel delivery through a greater number of openings.

Termination of fuel injection can be achieved by de-energisation of the first and second actuators 43, 43*b* to seat the first and second valve members 29*a*, 29*b* respectively, thereby re-establishing high fuel pressure within the first and second control chambers 20, 23.

In each of the embodiments described hereinbefore, the valve members 29, 29*a*, 29*b* are moved using an electromagnetic actuator. It will be appreciated, however, that the valve members may be moved using a piezoelectric actuator arrangement. For example, the valve member 29 may be connected directly to a piezoelectric stack, the energization level of the piezoelectric stack controlling the position of the valve member 29 and thus controlling the position occupied by the valve needle 10. Alternatively, a damping piston arrangement may be located between the valve member 29 and the piezoelectric stack to compensate for any small changes in the axial length of the piezoelectric stack resulting from, for example, thermal expansion. The provision of such a piston may further result in the injector operating in a failsafe manner, the valve member 29 eventually returning into engagement with the first seating surface 32, terminating fuel injection, even if the actuator becomes jammed in a position in which it is of relatively small axial length. As the stack is used to control movement of the valve member 29, the valve member 29 moving only through a small distance, in use, the stack can be of relatively small dimensions.

The valve member 29 and second valve member 35 are conveniently designed to be substantially fuel pressure balanced, thus the magnitude of the force which must be applied by the actuator, in use, is relatively small.

Figure 6:
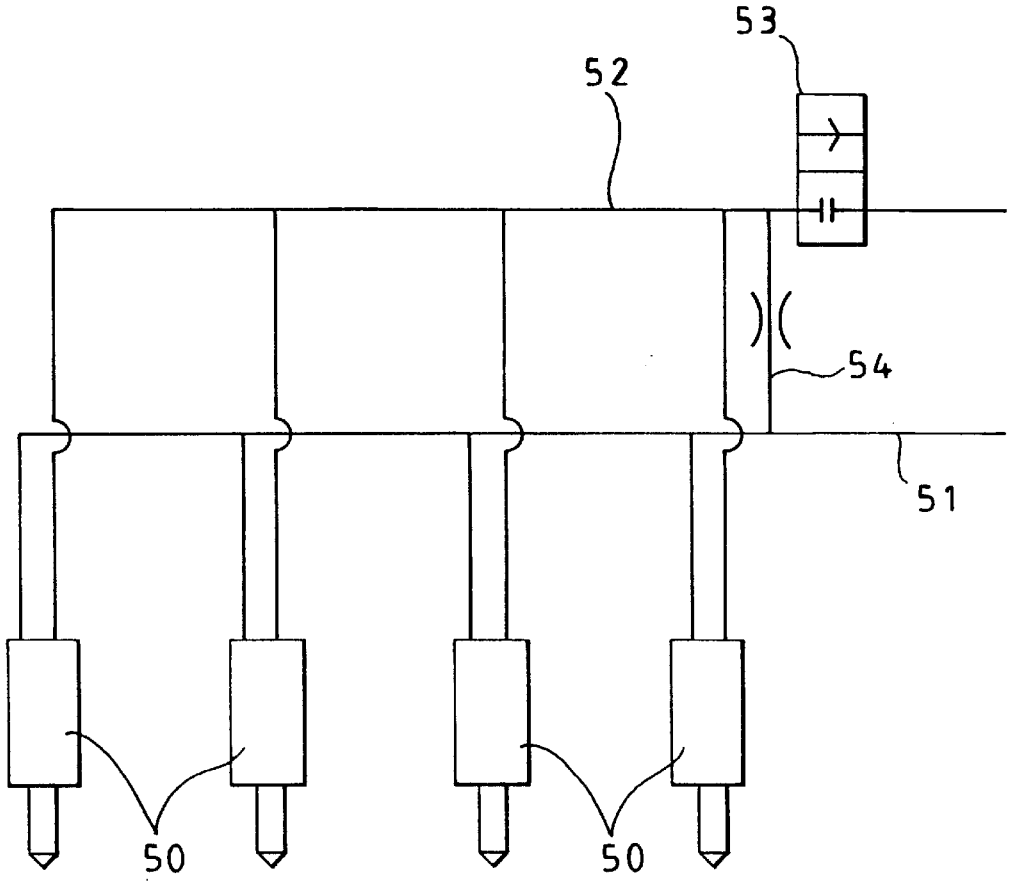
FIG. 6 is a schematic view illustrating a further embodiment.

FIG. 6 illustrates, schematically, an alternative arrangement in which fuel pressure within the second control chambers of a plurality of injectors is controlled in an alternative way. In the arrangement of FIG. 6, a plurality of fuel injectors 50 are arranged with their supply passages connected to a first rail 51 which is pressurized to a suitably high pressure by an appropriate high pressure fuel pump. Each injector 50 includes a first control chamber which is arranged to receive fuel from the supply passage, for example in the manner of the embodiments described hereinbefore. A suitable electromagnetically actuated valve is arranged to control communication between the control chamber and a low pressure drain reservoir.

Each injector further communicates with a second rail 52, the rail 52 communicating with the second control chamber (not illustrated) of each injector 50. The pressure of the second control chamber controls the position occupied by a stop member, for example as described hereinbefore. An electromagnetically or otherwise controlled valve 53 controls communication between the second rail 52 and a low pressure fuel reservoir. A restricted flow passage 54 provides communication at a restricted rate between the first and second rails 51, 52.

In use, with the valve 53 in the position illustrated, the rail 52 is at high pressure, the rail 52 being pressurized from the rail 51 through the restricted passage 54. It will be appreciated, therefore, that provided the electromagnetically actuable valve of each injector 50 is closed, both the first is and second control chambers of each injector are at high pressure. Actuation of the electromagnetically controlled valve of one of the injectors will permit the fuel pressure within the first control chamber of that injector 50 to fall, thus permitting movement of the needle of that injector by a small distance. As the fuel pressure within the second control chamber remains high, it will be appreciated that the valve needle is unable to move to a fully lifted position.

When the valve needle is to be moved to a fully lifted position, the valve 53 is energized to permit fuel to flow from the second rail 52 to a low pressure reservoir, thereby permnitting the fuel pressure within the second control chamber to fall and permitting movement of the moveable stop member. As a result, the valve needle is able to lift away from the seating surface by a further amount.

The arrangement in FIG. 6 provides the advantage that the need for the valve member 35 in FIGS. 1 to 4, and the need for the valve member 29 and the actuator 43 in FIG. 5, is removed, fuel pressure within the second control chamber being controlled by means of the valve 53. This has a cost advantage, particularly for systems having a large number of engine cylinders.

The operation of the valve 53 may occur sufficiently early relative to the operation of the valves of each injector to ensure that the needle moves substantially continuously to its fully lifted position. Alternatively, the valve 53 may be controlled to hold the needle in its intermediate position.

Figure 7:
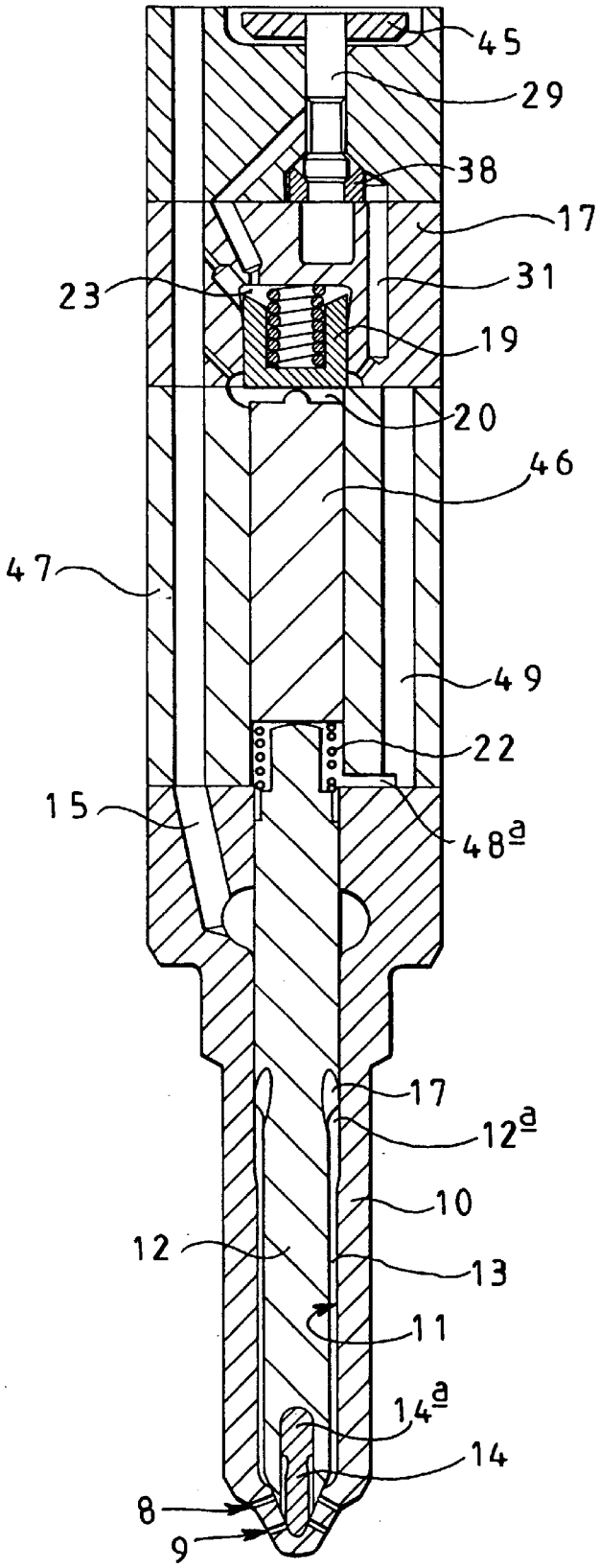
FIG. 7 is a cross-sectional view of a fuel injector in accordance with another embodiment of the invention.

Referring to FIG. 7, there is shown a further alternative embodiment of the invention in which like reference numerals are used to denote similar parts to those shown in FIGS. 1 to 5. As in FIG. 4, the injector includes a piston member 46 which is movable with the valve needle 12, a surface of the piston 46 being exposed to fuel pressure within the first control chamber 20. At its end remote from the valve needle 12, the piston 46 includes a projection 46*a*. The stop member 19 and the projection 46*a* of the piston 46 together define a clearance gap, g, which serves to limit the extent of movement of the valve needle 12 away from its seating, in use.

The stop member 19 is provided with a blind bore 100 which defines a spring chamber housing a compression spring 102, one end of the spring 102 being in abutment with the blind end of the bore 100 and the other end of the spring 102 being in abutment with the blind end of the bore 18. The spring 102 applies a biasing force to the stop member 19 which serves to urge the stop member 19 in a downwards direction such that the lower end surface thereof abuts a seating defined by the upper end surface of the piston housing 47.

The uppermost end of the bore within which the piston 46 is slidable, the lower surface of the stop member 19 and the upper surface of the piston 46 together define the first control chamber 20 for fuel, the control chamber 20 communicating with the supply passage 15 through the restricted passage 21. The control chamber 20 also communicates with the passage 31, the passage 31 including a region 31*a* of restricted diameter which serves to limit the rate at which fuel is able to escape from the first control chamber 20 through the passage 31.

The stop member 19 and the blind end of the bore 18 together define the second control chamber 23 for fuel, the control chamber 23 communicating with the supply passage 15 by means of the inlet passage 26, the inlet passage 26 including a region 26*a* of restricted diameter which serves to limit the rate of fuel flow into the control chamber 23. The control chamber 23 also communicates with the outlet passage 40 for fuel, the passage 40 including a region 40*a* of restricted diameter which serves to limit the rate at which fuel can escape from the second control chamber 23.

Figure 8:
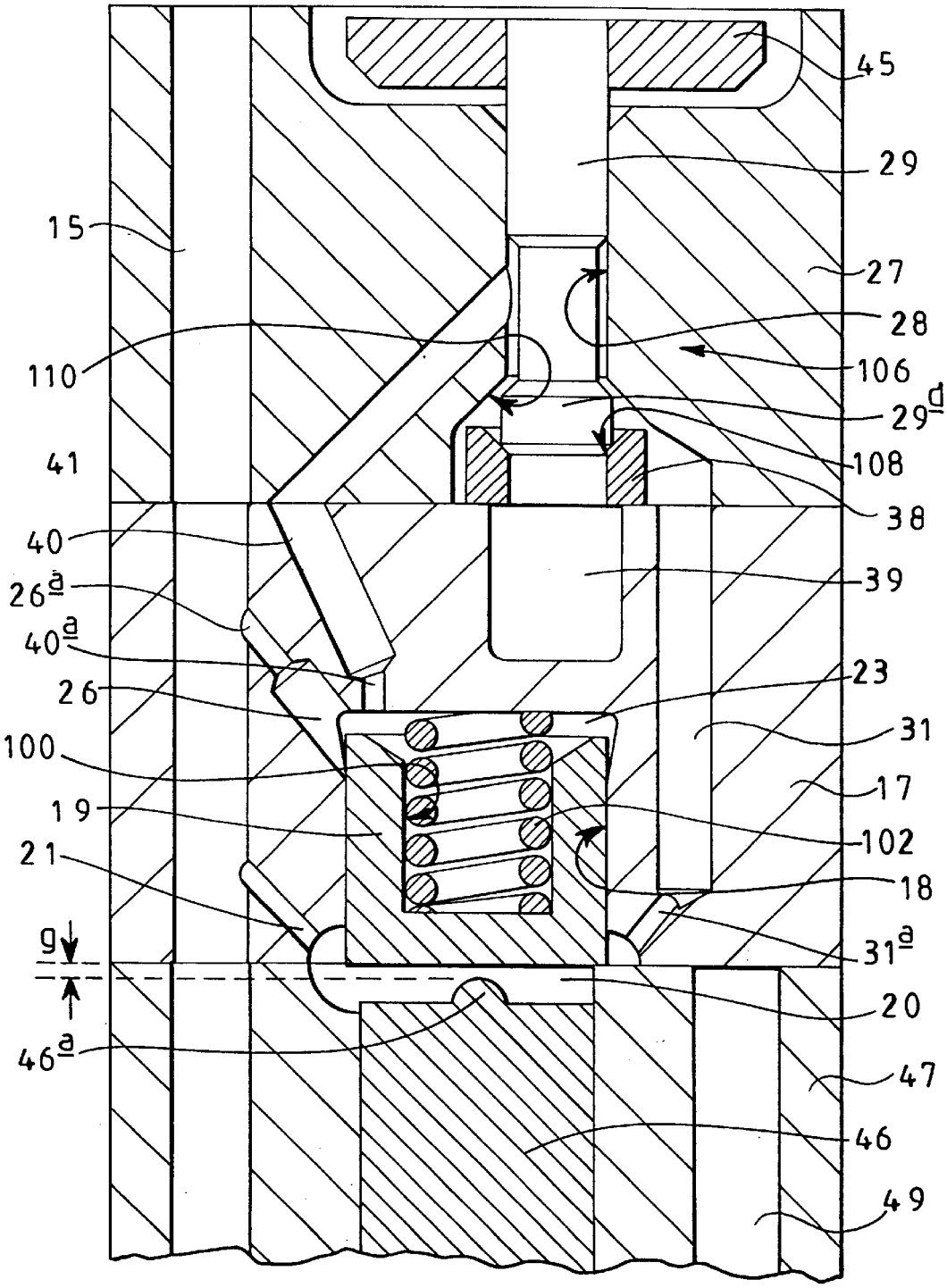
FIG. 8 is an enlarged cross-sectional view of a part of the fuel injector in FIG. 7.

The control valve arrangement 106 in FIGS. 7 and 8 is different from that shown in FIGS. 1 to 5 and takes the form of a 3-way valve arrangement. The control valve arrangement 106 includes a valve member 29 which is slidable within the bore 28 provided in the valve housing 27, the valve member 52 including an end region 29*d* of enlarged diameter which is engageable with first and second seating surfaces 108, 110 respectively. The first seating surface 108 is defined by the seating member 38 located within the chamber 41 and the second seating surface 110 is defined by the wall of the bore 28. The seating member 38 forms a substantially fluid tight seal with the upper end surface of the distance piece 17, the chamber 41 communicating with the chamber 39 defined by a recess provided in the end face of the distance piece 17. As the chamber 39 is in communication with the low pressure drain, when the valve member 29 is moved away from the first seating surface 108, fuel within the first control chamber 20 is able to flow through the passage 31, past the first seating surface 108, into the chamber 39 and to low pressure.

In use, with the supply passage 15 connected to a suitable source of fuel under high pressure, and with the actuator de-energised, the valve member 29 occupies the position illustrated in FIG. 8 in which it engages the first seating surface 108. Fuel under high pressure is delivered to the first and second control chambers 20, 23 through passages 21, 26 respectively. Under these circumstances, high pressure fuel within the control chamber 23 acts on the stop member 19 to urge the stop member 19 into engagement with its seating defamed by the upper end surface of the piston housing 47. Additionally, fuel pressure within the first control chamber 20 acts on the upper surface of the piston 46 and, in combination with the action of the spring 22, serves to urge the valve needle 12 into engagement with its seating. Thus, during this stage of operation, as the valve needle 12 engages its seating, fuel within the delivery chamber 13 is unable to flow through the first or second sets of outlet openings 8, 9 into the engine cylinder or other combustion space. Fuel injection does not therefore take place.

In order to commence fuel injection through the first set of outlet openings 8, the actuator arrangement is energised to cause movement of the valve member 29 at a relatively high rate away from the first seating surface 108 and into engagement with the second seating surface 110. During this stage of operation, with the valve member 29 lifted away from the first seating surface 108, fuel within the first control chamber 20 is able to escape through the passage 31, past the first seating surface 108 into the chamber 39 and to the low pressure drain. Fuel pressure within the first control chamber 20 is therefore reduced. With the valve member 29 moved into engagement with the second seating surface 110, fuel within the second control chamber 23 is unable to flow past the second seating surface 110 to low pressure such that fuel pressure within the second control chamber 23 remains high.

As fuel pressure within the first control chamber 20 is reduced, the valve needle 12 and the piston 46 are urged in an upwards direction, against the action of fuel pressure within the control chamber 20, due to fuel pressure within the delivery chamber 13 acting on the thrust surfaces 12*a* of the valve needle 12. Movement of the piston 46 and the valve needle 12 terminates when the projection 46a of the piston 46 engages the lower surface of the stop member 19 as high fuel pressure within the control chamber 23 maintains the stop member 19 in its seated position against the upper surface of the housing 47. As the valve needle 12 is only lifted through a relatively small distance, defined by the clearance gap, g, the step in the bore provided in the valve needle 12 does not move into engagement with the enlarged end region 14*a* of the inner valve needle 14. The inner valve needle 14 therefore remains seated against its seating and fuel within the delivery chamber 13 is unable to flow out through the second, lower set of outlet openings 9 into the engine cylinder. Thus, during this stage of operation, the valve needle 12 is lifted to a first fuel injecting position in which fuel injection only occurs through the first set of outlet openings 8.

During initial movement of the valve member 29 away from the first seating surface 108 it will be appreciated that some fuel within the second control chamber 23 is able to flow through the passage 40, past the second seating surface 110 and the first seating surface 108 to the low pressure drain. However, as movement of the valve member 29 away from the first seating surface 108 is at a relatively high rate, and as the regions 26*a*, 40*a* of the passages 26, 40 are of restricted diameter, fuel pressure within the second control chamber 23 is substantially maintained such that the movable stop member 19 remains seated, movement of the outer valve needle 12 therefore being limited by engagement between the projection 46*a* and the lower surface of the stop member 19.

In order to terminate fuel injection through the first set of outlet openings 8, the valve member 29 is moved away from the second seating surface 110 into engagement with the first seating surface 108 such that communication between the first control chamber 20 and the low pressure drain is broken. As fuel is continuously supplied to the control chamber 20 through the passage 21, high fuel pressure is re-established in the control chamber 20. The downward force on the piston 46 and the valve needle 12 is therefore increased, such that the valve needle 12 is moved into engagement with its seating to terminate fuel delivery through the first set of outlet openings 8.

Alternatively, if it is desired to inject fuel through both sets of outlet openings 8,9, the valve member 29 is moved away from the first seating surface 108, into engagement with the second seating surface 110, at a relatively low rate. Under these circumstances, a sufficient amount of fuel is able to escape from the second control chamber 23, through the passage 40 to the low pressure drain to cause fuel pressure within the second control chamber 23 to be reduced. Additionally, as described previously, with the valve member 29 moved away from the first seating surface 108, fuel within the first control chamber 20 is able to flow past the first seating surface 108 to the low pressure drain, thereby causing fuel pressure within the first control chamber 20 to be reduced. Fuel pressure within the delivery chamber 13 acting on the thrust surfaces 12*a* of the valve needle 12 causes the valve needle 12 and the piston 46 to move in an upwards direction such that the valve needle 12 lifts away from its seating. Upon engagement of the projection 46*a* of the piston 46 and the stop member 19, the stop member 19 is caused to move upwardly within the bore 18 against the force due to reduced fuel pressure within the second control chamber 23. Thus, the valve needle 12 is able to move away from its seating by a further amount, movement of the valve needle 12 terminating when the upper end surface of the stop member 19 engages the blind end of the bore 18.

During this stage of operation, the valve needle 12 is lifted away from its seating by an amount which is sufficient to cause the step in the bore provided in the valve needle 12 to engage the enlarged end region 14*a* of the inner valve needle 14. Movement of the valve needle 12 is therefore transmitted to the inner valve needle 14 such that the inner valve needle 14 also lifts away from its seating to permit fuel within the delivery chamber 13 to flow through the second set of outlet openings 9. Fuel injection therefore occurs, through both the first and second sets of outlet openings 8, 9, at an increased rate. It will therefore be appreciated that the fuel injection rate, or other fuel injection characteristics can be varied, depending on the rate of movement of the valve member 29 away from the first seating surface 108.

As described previously, in order to cease fuel injection following this stage of operation, the actuator arrangement is deenergised such that the valve member 29 moves away from the second seating surface 110 into engagement with the first seating surface 108 to break communication between the first control chamber 20 and the low pressure drain. Fuel pressure within the control chamber 20 therefore increases and the force acting on the piston 46 due to fuel pressure within the control chamber 20, in combination with the force due to the spring 22, serves to urge the valve needle 12 in a downwards direction into engagement with its seating to terminate fuel injection.

In an alternative mode of operation, in order to move the valve needle 12 to the second fuel injecting position in which both the valve needle 12 and the inner valve needle 14 are lifted away from their respective seatings, the valve member 29 may be moved back and forth between the first and second seating surfaces 108, 110. Repeated movement of the valve member 29 between the first and second seating surfaces 108, 110 causes fuel pressure within both the first and second control chambers 20, 23 to be reduced such that, as the projection 46a engages the lower surface of the stop member 19, the stop member 19 moves upwardly within the bore 18. It will be appreciated that, in this mode of operation, the extent of valve needle movement is controlled by repeated movement of the valve member 29 and is not determined by the rate of movement of the valve member 29.

In a further alternative mode of operation, the valve member 29 may be operated such that it is maintained in an intermediate position between the first and second seating surfaces 108, 110, thereby causing fuel pressure within both the first and second control chambers 20, 23 to be reduced. The valve needle 12 is therefore able to lift into its second fuel injecting position in which the stop member 19 is moved upwardly within the bore 18 due to engagement between the projection 46*a* of the piston 46 and the lower surface of the stop member 19. It will therefore be appreciated that, using a combination of one or more of the aforementioned modes of operation, the fuel injector can be operated so as to inject fuel through one or both sets of outlet openings 8,9, depending on the required fuel injection characteristics.

In an alternative arrangement to that shown in FIGS. 7 and 8, the passage 21 may be removed, the first control chamber 20 being supplied with high pressure fuel through leakage between the housing 47 and the distance piece 17.

Figure 9:
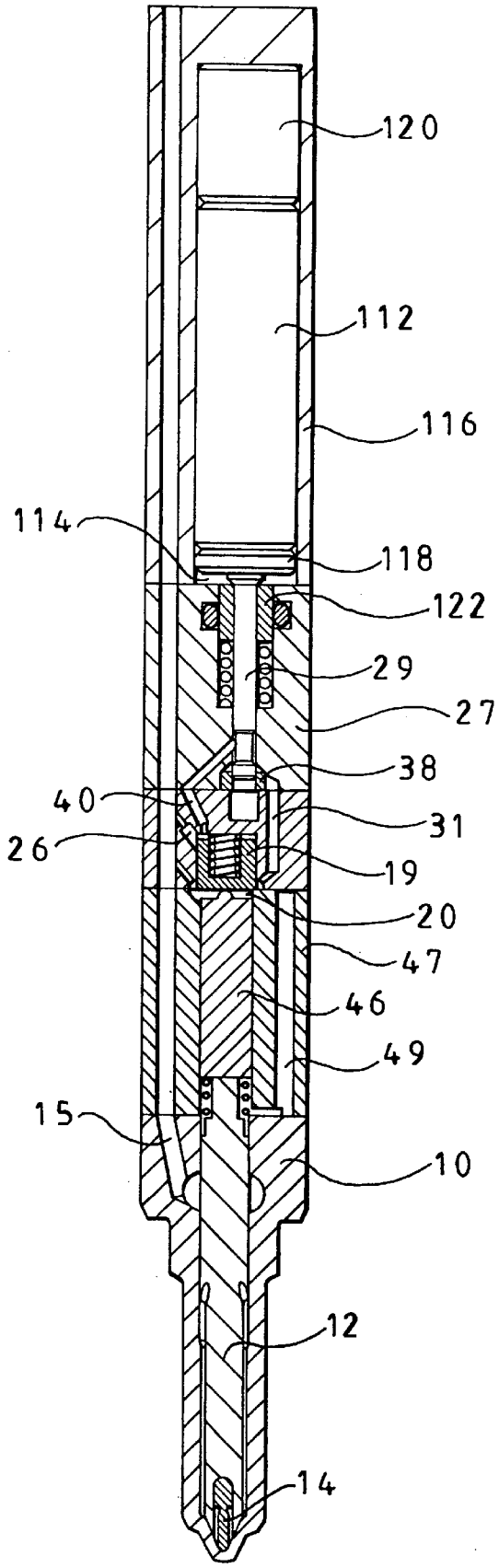
FIGS. 9, 11 and 13 are cross-sectional views of farther alternative embodiments.
Figure 10:
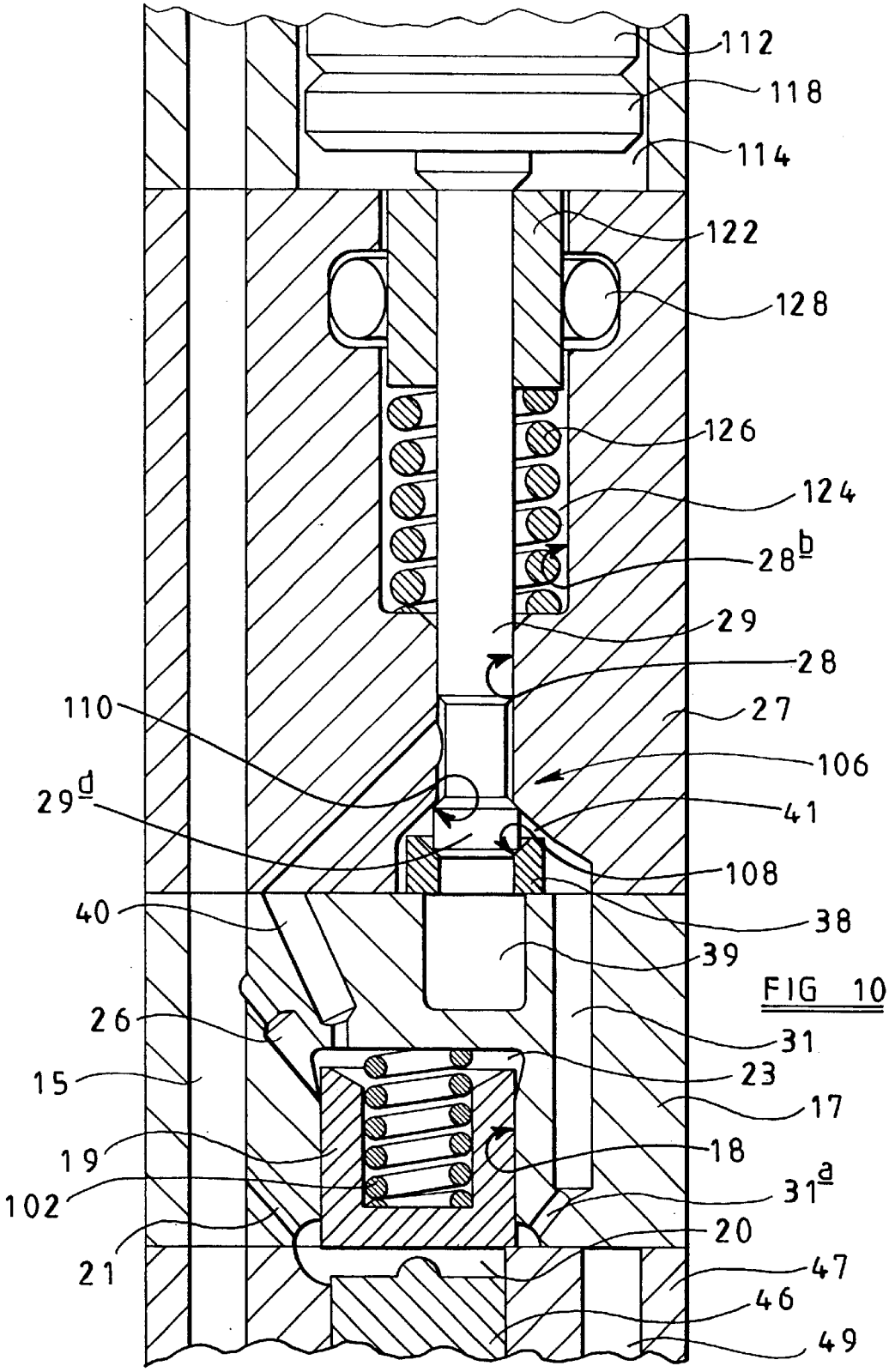
FIGS. 10, 12 and 14 are cross-sectional views of a part of the fuel injectors shown in FIGS. 9, 11 and 13 respectively.

Referring to FIGS. 9 and 10, there is shown an alternative embodiment of the invention in which the valve member 29 is operated by means of a piezoelectric actuator arrangement comprising a piezoelectric stack 112. The piezoelectric stack 112 is housed within a chamber 114 defined within a housing 116 and has an associated end plate member 118 which is secured or connected to the valve member 29. The piezoelectric stack 112 also includes a thermal expansion compensation element 120 located at its end remote from the end plate member 118. The member 120 has a higher coefficient of thermal expansion than the piezoelectric material forming the stack 112 and serves to compensate for thermal expansion of the housing 116. Typically, the piezoelectric material may be lead zirconate titanate, the member 120 may be formed from aluminium and the housing 116 may be formed from steel. The energisation level of the piezoelectric stack 112, and hence the axial length thereof, is controlled by applying an appropriate voltage across the stack 112, deenergisation of the piezoelectric stack 112 causing a decrease in the length of the stack 112 so as to cause movement of the valve member 29 away from the first seating surface 108 into engagement with the second seating surface 110.

The valve member 29 extends through, and is movable with, a sleeve member 122, the sleeve member 122 being slidable within an enlarged region 28*b* of the bore 28 provided in the valve housing 27. The region 28*b* of the bore also defines a spring chamber 124 housing a compression spring 126, the spring 126 being arranged to urge the valve member 29 against the second seating surface 110. With the piezoelectric stack 112 energised, the valve member 29 adopts a position in which it engages the first seating surface 108, deenergisation of the stack 112 causing movement of the valve member 29 away from the first seating surface 108 into engagement with the second seating surface 110 under the action of the spring 126. The chamber 124 communicates with the low pressure drain, a seal member 128 being arranged within the region 28*b* of the bore to prevent fuel within the chamber 124 flowing into the chamber 114 and causing damage to the piezoelectric stack 112.

In order to move the valve needle 12 by a first, relatively small amount into a first fuel injecting position in which fuel is delivered through only the first set of outlet openings 8, the piezoelectric stack 112 is deenergised at a relatively high rate. The valve member 29 therefore moves away from the first seating surface 108 at a relatively high rate into engagement with the second seating surface 110. As described previously for the embodiment of the invention shown in FIGS. 7 and 8, such relatively rapid movement of the valve member 29 causes fuel pressure within the first control chamber 20 to be reduced, whilst substantially maintaining high fuel pressure within the second control chamber 23. The valve needle 12 is therefore moved away from its seating into the first fuel injecting position in which fuel is only delivered through the first set of outlet openings 8, the inner valve needle 14 remaining seated against its seating to prevent fuel delivery through the second set of outlet openings 9.

The embodiment of the invention in FIGS. 9 and 10 may also be operated in any of the alternative modes of operation described previously, for example by varying the rate of movement of the valve member 29, by repeatedly moving the valve member 29 back and forth between the first and second seating surfaces 108, 110 or by maintaining the valve member 29 in an intermediate position between the first and second seating surfaces 108, 110 by partially deenergising the piezoelectric stack to an intermediate energisation level. It will be appreciated that, in order to terminate fuel injection, the piezoelectric stack 112 is energised to cause the valve member 29 to move into engagement with the first seating surface 108, thereby breaking communication between the first control chamber 20 and the low pressure drain.

Figure 11:
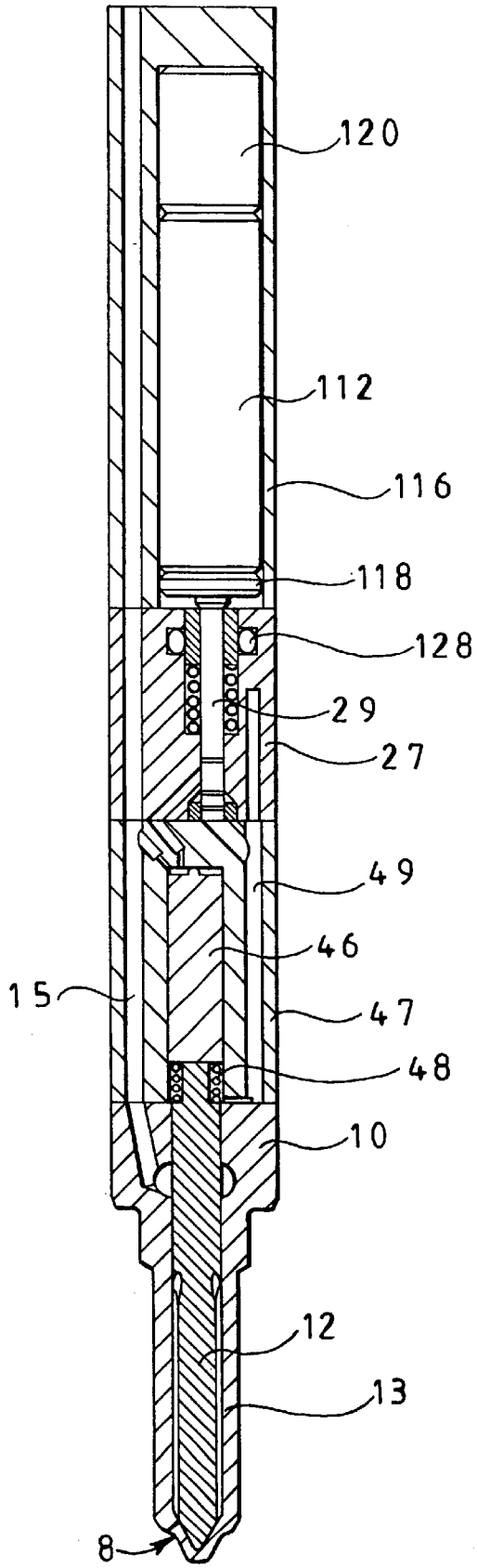
Figure 12:
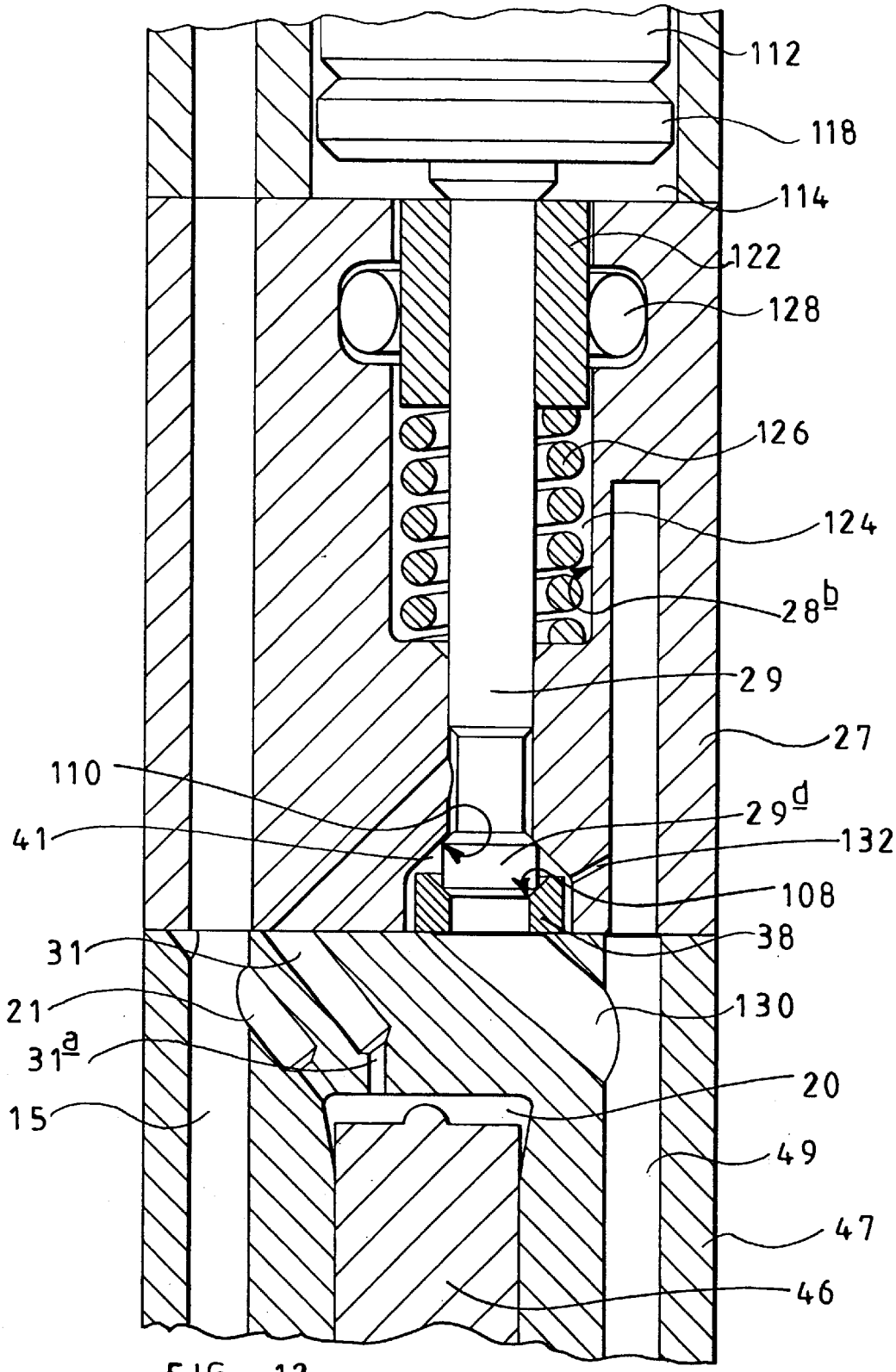

Referring to FIGS. 11 and 12, there is shown an alternative embodiment of the invention in which the rate of movement of the valve needle 12 away from its seating can be controlled. In this embodiment, the passage 49 (only partially shown) in communication with the chamber 48 extends through the housings 47, 27 and communicates with the low pressure drain. The passage 49 also communicates with one end of a further drilling 130 provided in the housing 47, the other end of the drilling 130 communicating with the chamber 41. The valve housing 27 is also provided with a restricted passage 132, one end of which communicates with the chamber 41 and the other end of which communicates with the passage 49 to permit fuel within the chamber 41 to flow to low pressure.

The compression spring 126 is arranged such that, when the piezoelectric stack 112 is de-energised, the valve member 29 is urged against the second seating surface 110 to prevent fuel in the control chamber 20 escaping to low pressure. Thus, with the piezoelectric stack 112 de-energised and with fuel under high pressure supplied to the control chamber 20, fuel pressure within the control chamber 20 remains high and serves to urge the piston 46 and the valve needle 12 in a downwards direction such that the valve needle 12 remains seated against its seating. During this stage of operation, fuel injection does not take place.

In order to move the valve needle 12 away from its seating at a relatively low rate, the piezoelectric stack 112 is energised such that the valve member 29 moves away from the second seating surface 110 into engagement with the first seating surface 108. Under these circumstances, fuel within the control chamber 20 is able to flow through the passage 31, past the second seating surface 110 and through the restricted passage 132 to the low pressure drain, thereby causing fuel pressure in the control chamber 20 to be reduced. Initial movement of the valve member 29 away from the second seating surface 110 is sufficient to reduce fuel pressure within the control chamber 20 to a sufficiently low level that the piston 46 and the valve needle 12 are moved in an upwards direction. Fuel within the delivery chamber 13 is therefore able to flow through the outlet openings 8. Following initial injection, the rate at which valve needle movement occurs is controlled by the rate at which fuel can escape from the control chamber 20 to low pressure through the restricted passage 132 as, following engagement between the valve member 29 and the first seating surface 108, fuel can only escape to low pressure through the passage 132. As fuel can only escape through the restricted passage 132 at a relatively low rate, this gives rise to a relatively low rate of valve needle movement and, hence, a relatively low rate of increase of fuel injection through the outlet openings 8.

In order to achieve a higher rate of opening of the valve needle, the valve member 29 may be moved away from the second seating surface 110 at a relatively low rate such that, upon initial movement of the valve member 29 away from the second seating surface 110, fuel is able to flow through the passage 31, past the first seating surface 108 to low pressure for a period of relatively long duration before the valve member 29 engages the first seating surface 108. It will be appreciated that, due to the dimensions of the restriction 31*a* and the restricted passage 132, valve needle movement at relatively high rates is governed by the dimensions of the restriction 31*a* whereas the valve needle movement at relatively low rates is governed by the dimensions of the restricted passage 132. Thus, by varying the rate at which the valve member 29 is moved between the seating surfaces 108, 110, to change the mode of operation from one in which the rate of valve needle movement is governed by the dimensions of the restriction 31*a* to one in which the rate of valve needle movement is governed by the dimensions of the restricted passage 132, it is possible to achieve a variable injection rate.

In an alternative mode of operation, in order to achieve valve needle movement at a relatively high rate the valve member 29 may be moved back and forth at a relatively high rate between the first and second seating surfaces 108, 110. In a further alternative mode of operation, in order to achieve valve needle movement at a relatively high rate the valve member 29 may be controlled such that it maintains an intermediate position between the first and second seating surfaces 108, 110 to permit fuel within the control chamber 20 to flow to low pressure past both the second seating surface 110 and the first seating surface 108.

In order to terminate fuel injection, the valve member 29 is moved against the second seating surface 110 by de-energising the piezoelectric stack 112 such that high fuel pressure within the control chamber 20 is re-established, The piston 46 and the valve needle 12 are therefore urged in a downwards direction such that the valve needle 12 engages its seating, breaking communication between the delivery chamber 13 and the outlet openings 8.

It will be appreciated that the embodiment of the invention in FIGS. 11 and 12 may be arranged to control movement of a valve needle of a two or multi stage lift injector by controlling movement of the valve member 29 such that the rate at which fuel is able to escape from the control chamber 20 is sufficiently low to maintain the valve needle 12 in a first fuel injecting position for a sufficient period of time.

Figure 13:
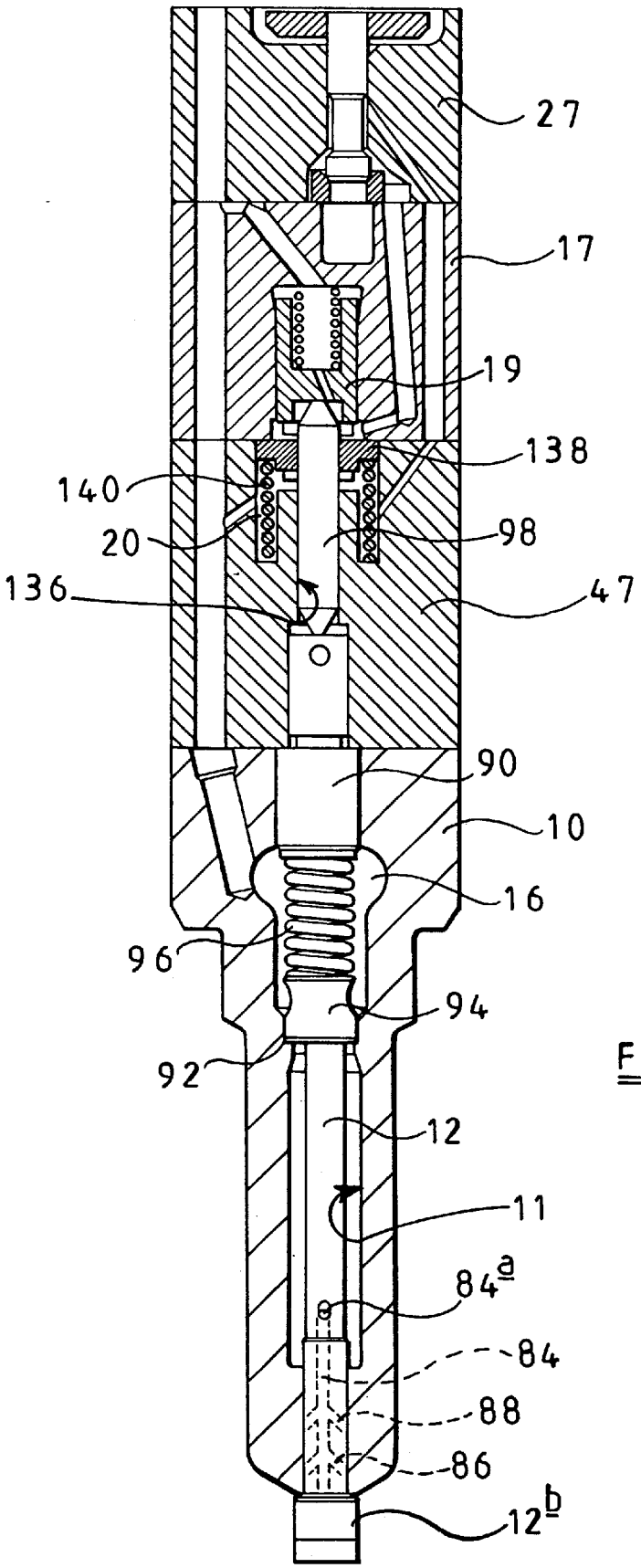
Figure 14:
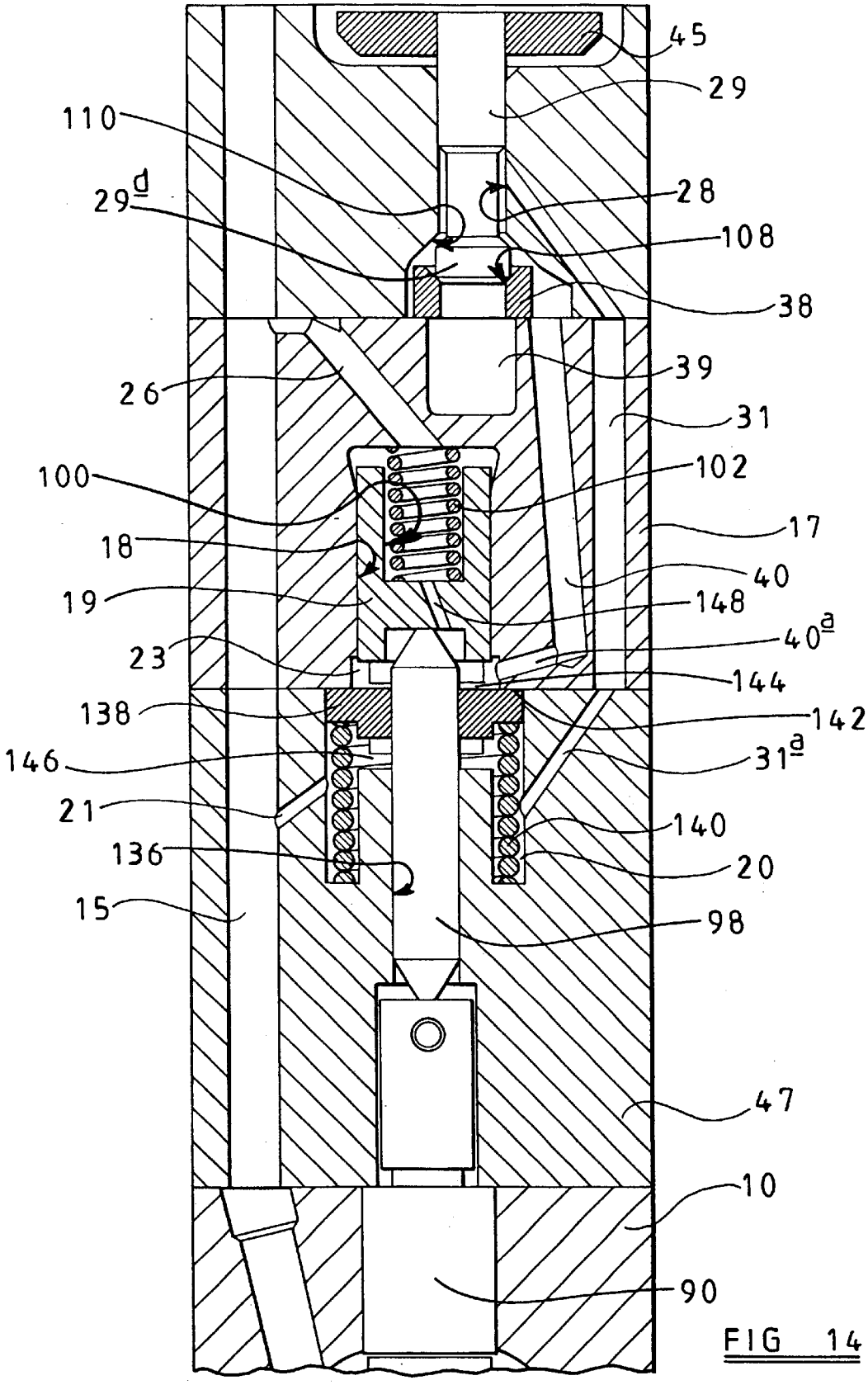

Referring to FIGS. 13 and 14, there is shown a further alternative embodiment of the invention in which the fuel injector takes the form of an outwardly opening injector. Similar parts to those shown in FIGS. 1 to 12 are denoted with like reference numerals and will not be described in further detail hereinafter. The valve needle 12 is moveable outwardly within the bore 11 and includes, at its lowermost end, a region 12*b* of enlarged diameter which is engageable with a seating to control the supply of fuel from the injector. The valve needle 12 is provided with a central bore 84 communicating, through a drilling 84*a*, with the bore 11 and with first and second outlet passages 86, 88 respectively, the first and second outlet passages being axially spaced on the valve needle 12. Only two outlet passages are shown at each axial position, but it will be appreciated that a different number of outlet passages may be provided.

The upper end of the valve needle 12 is provided with a screw thread formation (not shown) which engages a corresponding formation provided on the interior of a first spring abutment member 90. The spring abutment member 90 takes the form of a cylindrical sleeve having an outer diameter slightly smaller than the diameter of the adjacent part of the bore 11. The bore 11 defines a step 92 with which a second spring abutment member 94 engages. A compression spring 96 is located between the first and second spring abutment members 90, 94 to bias the valve needle 12 in an upwards direction and therefore to bias the enlarged region 12*b* of the valve needle 12 into engagement with its seating.

The upper end of the valve needle 12 engages a lower end of a thrust member 98, the other end of the thrust member 98 engaging the stop member 19. The thrust member 98 extends centrally through the first control chamber 20 and is slidable within a bore 136 provided in the housing 47. A second, annular stop member 138 is housed within the first control chamber 20, the inner diameter of the stop member 138 being slightly larger than the diameter of the thrust member 98 such that the stop member 138 forms a close fit around the thrust member 98. A compression spring 140 is also housed within the first control chamber 20, the spring 140 serving to bias the stop member 138 in an upwards direction against a seating 142 defined by a part of the lower end face of the housing 17. When the stop member 138 is in its seated position, there is a substantially fluid tight seal between the distance piece 17 and the stop member 138. As can be seen most clearly in 14, the lower surface of the stop member 19 and the upper surface of the stop member 138 together define a first clearance gap 144 within the second control chamber 23 and the lower surface of the stop member 138 and the housing 47 together define a second clearance gap 146 within the first control chamber 20, the clearance gaps 144, 146 serving to limit the extent of movement of the valve needle 12 away from its seating, in use, as will be described hereinafter.

The second control chamber 23 is defined by the distance piece 17, part of the thrust member 98, the lower surface of the stop member 19 and a part of the upper surface of the stop member 138, the thrust member 98 extending centrally through the second control chamber 23 and engaging the stop member 19. In use, fuel is supplied to the second control chamber 23 via a drilling 148 provided in the stop member 19, the drilling 148 communicating with the bore 18 within which the stop member 19 is slidable to permit fuel supplied through the passage 26 to the bore 18 to flow into the control chamber 23.

In use, prior to the commencement of fuel injection, the valve member 29 is positioned such that it is seated against the first seating surface 108. Fuel supplied through the supply passage 15 flows into the bore 100 and, hence, into the control chamber 23 via the drilling 148. Fuel also flows into the first control chamber 20 through the passage 21. The nozzle body 10 and the valve needle 12 are appropriately dimensioned to ensure that, in such circumstances, the valve needle 12 is biased in an upwards direction due to fuel pressure within the bore 11 and due to the force of the spring 96.

In order to commence fuel injection at a relatively low rate, the actuator arrangement is operated so as to move the armature 45 thereof in an upwards direction at a relatively high rate, thereby causing the valve member 29 to move away from the first seating surface 108 at a relatively high rate into engagement with the second seating surface 110. Fuel in the second control chamber 23 is therefore able to flow through the passages 40, 40*a*, into the chamber 39 and to low pressure. Fuel pressure within the second control chamber 23 is therefore reduced, the passage 148 restricting the rate at which fuel can enter the second control chamber 23 such that the stop member 19 moves in a downwards direction due to the force applied by fuel pressure in the blind end of the bore 18. The movement of the stop member 19 is transmitted, through the thrust member 98, to the valve needle 12. The rate at which fuel flows from the second control chamber 23 to low pressure is determined by the dimensions of the narrow passage 40*a*.

When the stop member 19 has moved in a downwards direction by an amount equal to the clearance gap 144, the stop member 19 moves in abutment with the upper surface of the stop member 138. As the valve member 29 is moved away from the first seating surface 108 into engagement with the second seating surface 110 at a relatively high rate, fuel pressure within the first control chamber 20 is substantially maintained such that the stop member 138 remains seated against the seating 142. Thus, although the stop member 19 moves into abutment with the stop member 138, it does not provide sufficient force to overcome fuel pressure in the first control chamber 20 and to move the stop member 138 away from the seating 142. The enlarged region 12*b* of the valve needle 12 is therefore moved away from its seating by a first amount such that the first outlet passages 86, but not the second outlet passages 88, are exposed. Fuel is therefore delivered to the engine cylinder through the first outlet passages 86 only and fuel injection occurs at a relatively low rate.

In order to terminate fuel injection, the valve member 29 is moved away from the second seating surface 110 into engagement with the first seating surface 108 to re-establish high fuel pressure within the second control chamber 23, thereby causing the stop member 19 to move in an upwards direction due to fuel pressure within the bore 11 acting on the thrust surfaces of the valve needle 12. The enlarged region 12*b* of the valve needle 12 therefore moves into engagement with its seating to terminate fuel delivery through the first outlet passages 86.

In order to inject fuel through both the first and second outlet passages 86, 88, the valve member 29 may be operated such that it moves in an upwards direction away from the first seating surface 108 into engagement with the second seating surface 110 at a relatively low rate. Under such circumstances, fuel within the first control chamber 20 is able to escape through the passages 31, 31*a*, past the first seating surface 108 and to low pressure to cause fuel pressure within the first control chamber 20 to be reduced. Fuel pressure within the second control chamber 23 is also reduced, as described previously, such that, as the stop member 19 moves into engagement with the stop member 138, the stop member 138 is moved in a downwards direction away from the seating 142. The thrust member 98 therefore moves in a downwards direction by a further amount, determined by the clearance gap 144 and the clearance gap 146, such that the enlarged region 12*b* of the valve needle 12 is moved away from its seating to expose both the first and second outlet passages 86, 88. It will therefore be appreciated that the rate of fuel injection is increased.

It will be appreciated that the fuel injector in FIGS. 13 and 14 may also be operated in any of the other modes of operation described previously. For example, the valve member 29 may be repeatedly moved back and forth between the first and second seating surfaces 108, 110 or may be maintained in an intermediate position between the first and second seating surfaces 108, 110 to permit the fuel injection rate or other fuel injection characteristics of the outwardly opening injector to be varied, in use.

It will be appreciated that a piezoelectric actuator arrangement or an electromagnetic actuator arrangement may be used to control movement of the valve member forming part of the outwardly opening injector.

In any of the embodiments described herein, the supply passage 15 may be provided with a restriction of relatively small diameter which is arranged to restrict the rate at which fuel is supplied to the bore 11 and the delivery chamber 13. As a result of the presence of such a restriction, during fuel injection fuel pressure within the delivery chamber 13 will fall such that the magnitude of the force acting upon the valve needle 12 during injection will be lower than that present prior to commencement of injection.

It will be appreciated that the injector may be provided with a different number of outlet openings to those shown in the accompanying drawings and/or may be provided with further sets of outlet openings occupying different axial positions on the nozzle body.

What is claimed is:

1. A fuel injector comprising a valve needle slidable within a first bore and engageable with a valve needle seating, a surface associated with the valve needle being exposed to the fuel pressure within a first control chamber, movement of the valve needle away from the valve needle seating being limited by a moveable stop member, the stop member having a surface exposed to fuel pressure within a second control chamber, and a control valve arrangement for controlling the fuel pressure within the first and second control chambers to control movement of the valve needle and the stop member wherein the control valve arrangement includes a valve member having first and second seating surfaces and at least one of the seating surfaces is defined by a seating member located within a further chamber.

2. The fuel injector as claimed in claim 1, wherein the further chamber is defined, at least in part, by a further bore within which the valve member is slidable.

3. The fuel injector as claimed in claim 2, wherein at least one of the seating surfaces is defined by a region of the further bore.

* * * * *